US008698613B2

(12) United States Patent
McEvoy

(10) Patent No.: US 8,698,613 B2
(45) Date of Patent: Apr. 15, 2014

(54) INTEGRATED TEST-MODE FOR MONITORING OF FIRE AND SECURITY SYSTEM NETWORKS

(75) Inventor: Dennis McEvoy, Groton, MA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 325 days.

(21) Appl. No.: 13/042,191

(22) Filed: Mar. 7, 2011

(65) Prior Publication Data

US 2012/0229269 A1 Sep. 13, 2012

(51) Int. Cl.
*G08B 29/00* (2006.01)
*G08B 17/00* (2006.01)

(52) U.S. Cl.
USPC ..... 340/506; 340/514; 340/286.05

(58) Field of Classification Search
USPC ..... 340/514, 506, 507, 516, 517, 539.16, 340/539.1, 500, 501, 508, 539.11, 10.32, 340/12.37, 286.05; 702/182; 365/222; 73/865.9
See application file for complete search history.

(56) References Cited

U.S. PATENT DOCUMENTS

| | | | | |
|---|---|---|---|---|
| 5,440,301 | A | 8/1995 | Evans | |
| 6,313,744 | B1 * | 11/2001 | Capowski et al. | 340/514 |
| 7,027,808 | B2 | 4/2006 | Wesby | |
| 7,038,582 | B2 * | 5/2006 | Hom et al. | 340/514 |
| 7,227,450 | B2 | 6/2007 | Garvy et al. | |
| 7,649,450 | B2 * | 1/2010 | Campion et al. | 340/514 |
| 8,228,182 | B2 * | 7/2012 | Orsini et al. | 340/514 |
| 2009/0243840 | A1 | 10/2009 | Petite et al. | |

* cited by examiner

*Primary Examiner* — Anh V La
(74) *Attorney, Agent, or Firm* — Kacvinsky Daisak PLL

(57) ABSTRACT

An improved system and method are disclosed for providing test functionality for fire and security system monitoring networks. An operator at a workstation node can place points into a "test-mode" while those points remain "live" (i.e., the system remains operational). For points placed in test-mode, if/when such points transition into a non-normal state (e.g., an alarm state), no flashing or other indication requiring a manual acknowledgement from the operator of the workstation node will occur. In addition, for systems employing banners, active lists, automatic printouts or graphics icons that indicate events, no such indications will occur at the workstation node. The disclosed system and method can also generate documentation verifying completion of system testing in accordance with local jurisdictional requirements. Other embodiments are described and claimed.

20 Claims, 15 Drawing Sheets

INTEGRATED TEST-MODE FOR MONITORING OF FIRE AND SECURITY SYSTEM NETWORKS

FIELD OF THE DISCLOSURE

The disclosure is generally related to the field of fire and security systems, and more particular to an improved system and method for providing fire and security system test functionality for observation and control at one or more workstation nodes.

BACKGROUND OF THE DISCLOSURE

Systems and methods are known for providing remote monitoring of fire and security systems installed in commercial and residential buildings. Often, such remote monitoring systems include a workstation that allows a operator to monitor the status of a variety of "points" (e.g., smoke detectors, motion detectors, heat detectors) installed as part of a fire and/or security system network for an associated building. The workstation allows an operator to monitor the general status of the system, and to observe "events" associated with one or more points in the system. The changing of a smoke detector (i.e., a "point") from a "normal" to a "fire" state is one example of an event in the system that can be monitored and acknowledged via such a workstation.

Various local governmental entities may require the points of a fire system to be tested periodically to ensure proper operation. Such testing may involve a workman performing a system walkthrough to manually configure each point into an alarm state (e.g., pressing a test button or otherwise manually alarming the point). Alarm signals are sent from each point via the network to a local system panel. The same alarm signals are also sent to the workstation node, where a user interface provides a visual display of the testing process, and where diagnostic programs can build a historical record of the testing of the system. As will be appreciated, such testing can uncover improper or abnormal operation of one or more points in the system. Subsequent repair or replacement of such improperly functioning points can then be accomplished. The compilation of a historical record of testing may be used to prove compliance with local jurisdictional requirements.

For obvious reasons, it desirable to perform such testing while the network is "live" (i.e., while the system is in operation). Where a workstation is monitoring a network with live points, the workstation typically issues audible and/or visual alerts to an operator to indicate alarm conditions occurring in portions of the system being tested. For example, an abnormal point state change can cause the workstation to annunciate its occurrence in sounds and graphics, in flashes, and in colors. This activity alerts the operator to take an action, and the workstation node accepts an operator action, as long as the operator is logged on with applicable permissions. Since the workstation may monitor a plurality of networks, and each network can include a multiplicity of points, a substantial number of events must be affirmatively acknowledged by the operator during test evolutions. As such, current test arrangements require a high degree of operator attention.

It would, therefore, be desirable to reduce or eliminate the operator burden associated with manually acknowledging individual events associated with system testing. It would also be desirable to compile a historical record of system testing to document compliance with local jurisdictional testing requirements.

SUMMARY OF THE DISCLOSURE

A system and method are disclosed for temporarily placing points of a fire or security system into a "test-mode" so that a workstation node operator will not be required to manually acknowledge events generated during testing. The disclosed system and method can also generate documentation verifying completion of system testing in accordance with local jurisdictional requirements. Thus, the disclosed system and method provide a historical record of all network device test events without creating nuisance activity at the workstation node. A system is disclosed for monitoring and testing a fire or building system, comprising: a workstation comprising a processor coupled to an operator interface, and a building system comprising a plurality of system points, the workstation in communication with said building system for monitoring said system points; the workstation configured to designate a plurality of system points for inclusion in a test-mode operation, to receive event notifications representative of a status of at least one of said plurality of system points, to log said event notifications in a log, and to update an active points list to reflect the event without requiring operator acknowledgement of the event.

A method is also disclosed for testing a fire or building system, comprising: designating a plurality of system points for inclusion in a test-mode operation; during said test-mode operation, generating an event notification representative of a status of at least one of said plurality of system points; logging said event notification in a log; and updating an active points list to reflect the event, without requiring operator acknowledgement of the event.

BRIEF DESCRIPTION OF THE DRAWINGS

By way of example, specific embodiments of the disclosed system and method will now be described, with reference to the accompanying drawings.

DETAILED DESCRIPTION

An improved system and method are disclosed for enabling an operator at a workstation node to place points into a "test-mode" while those points remain "live" (i.e., the system remains operational). In one embodiment, adding or removing a point in or out of this test-mode will not change the state of the point at the associated panel (i.e., the point will remain a live point at the panel). In addition, for points placed in test-mode, if/when such points transition into a non-normal state (e.g., an alarm state), no flashing or other indication requiring a manual acknowledgement from the operator of the workstation node will occur. In addition, for systems employing banners, active lists, automatic printouts or graphics icons that indicate events, no such indications will occur at the workstation node. It will be appreciated that the disclosed system and method will result in reduced operator burden as compared to current arrangements that require multiple operator acknowledgements during periodic point testing.

Although the description will proceed in reference to a single "workstation node," it will be appreciated that this term should be interpreted as including one or more hard-wired or wirelessly connected workstation nodes, and as also including one or more hard-wired or wirelessly connected remote clients. In one embodiment, the disclosed workstation node includes a variety of monitoring and display functionality, including head-end annunciation, floor plan display, system control, and information management for fire and building system networks.

Figure 1:
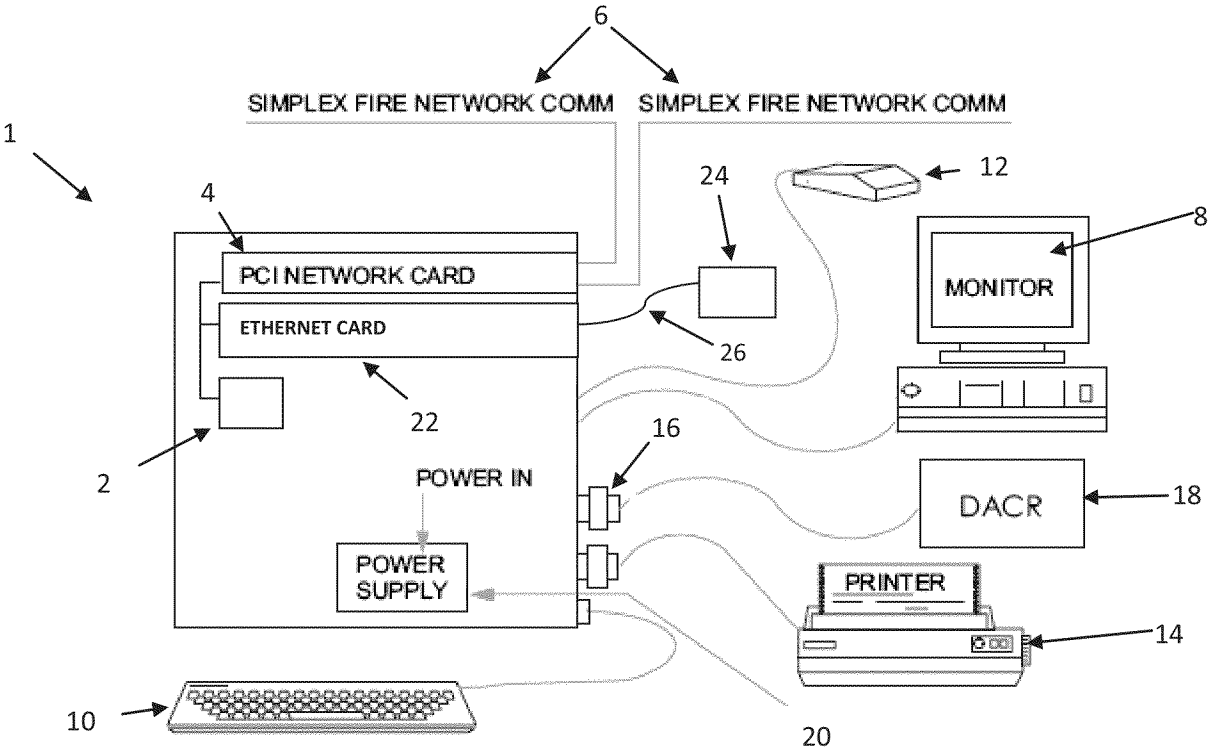
FIG. 1 is system diagram illustrating a workstation based system for monitoring a plurality of fire systems.

As will be described in greater detail, the workstation node is an information manager that processes, maintains, and groups information about one or more monitored systems for ease of use. Referring to FIG. 1, an exemplary workstation node 1 has a processor 2, a PCI network card 4 for connection to a plurality of fire networks 6, a display 8, keyboard 10, mouse 12 and printer 14 for user interface, a serial port 16 for connection to a Digital Alarm Communication Receiver (DACR) 18, and a power supply 20. The workstation 1 may also have an Ethernet card 22 for connecting to a remote client 24 via a network 26 such as a local area network (LAN) or virtual private network (VPN).

As will be discussed in greater detail below, the workstation 1 may display a variety of windows and tab selections that can be used by an operator to configure one or more points of an associated fire system, and to display the status of those points. It will be appreciated that although the description will proceed by referring to a "fire system," that the disclosed system and method is not so limited, and can be used in a variety of other types of systems, a non-limiting example of which includes security systems. It will also be appreciated that the functional capabilities described herein are merely exemplary, and that the workstation node 1 may incorporate additional system control and/or monitoring functionality.

As previously noted, the disclosed test-mode feature allows an operator at a workstation node 1 to place one or more points of a monitored fire system into test-mode. In one embodiment, a workstation node may be part of a multi-node network, including a plurality of individual panels, where each panel supports a plurality of individual points. For example, the workstation node 1 may be located in a guard shack associated with a monitored building, and may be connected to one or more fire system networks via an Ethernet or other connection. In some embodiments, the workstation node functionality may enabled in a remote client 24, facilitating fire system monitoring and control by an operator located at a location far remote from the monitored building.

The disclosed system and method can also provide a single history log that includes all network test events in order to prove that, for example, one or more points in a building are being tested in accordance with local governmental requirements. Such a log can facilitate repair of improperly functioning points, and also provides a concurrent compilation of documentation to prove testing has been completed.

Figure 2:
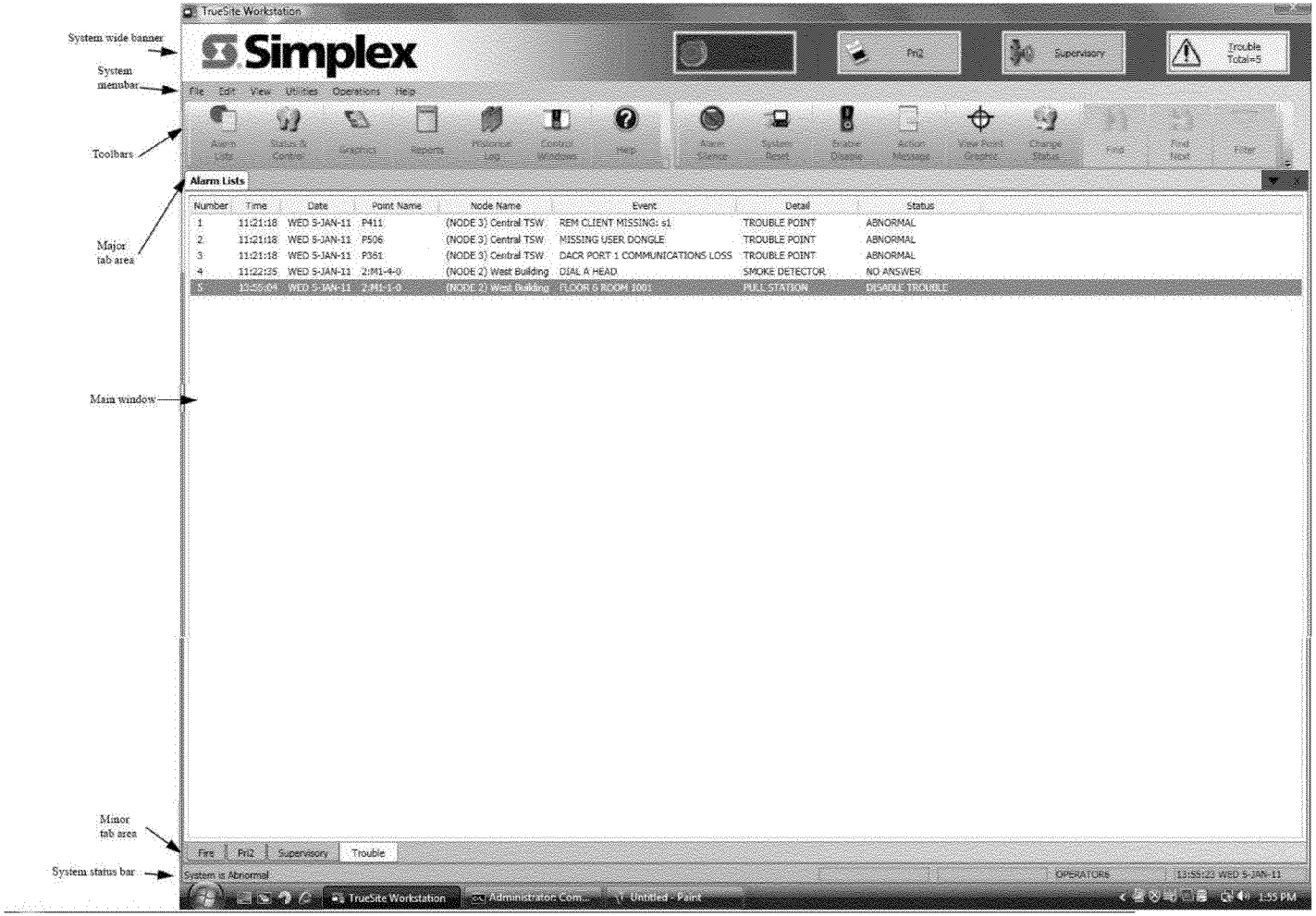
FIG. 2 is an exemplary screen shot showing a workstation node GUI.

Referring now to FIG. 2, an exemplary operator interface screen shot is shown. The operator interface has a layout composed of the following blocks: system wide banner, system menu bar, toolbars, main tab area, major window, and minor tab area, and system status bar.

Figure 3:
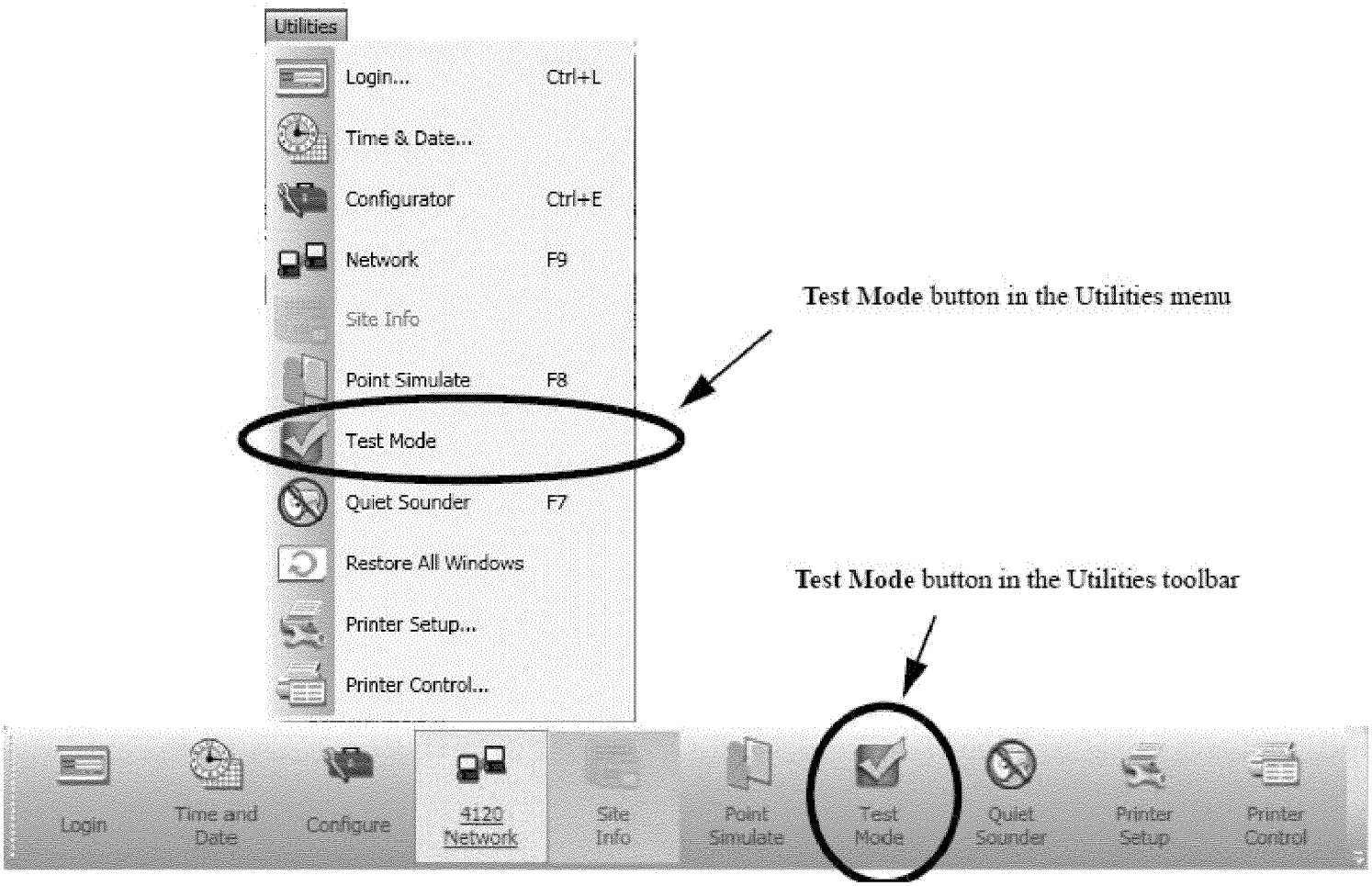
FIG. 3 is an exemplary screen shot showing a test mode button in the utilities menu and toolbar of FIG. 2.
Figure 4:
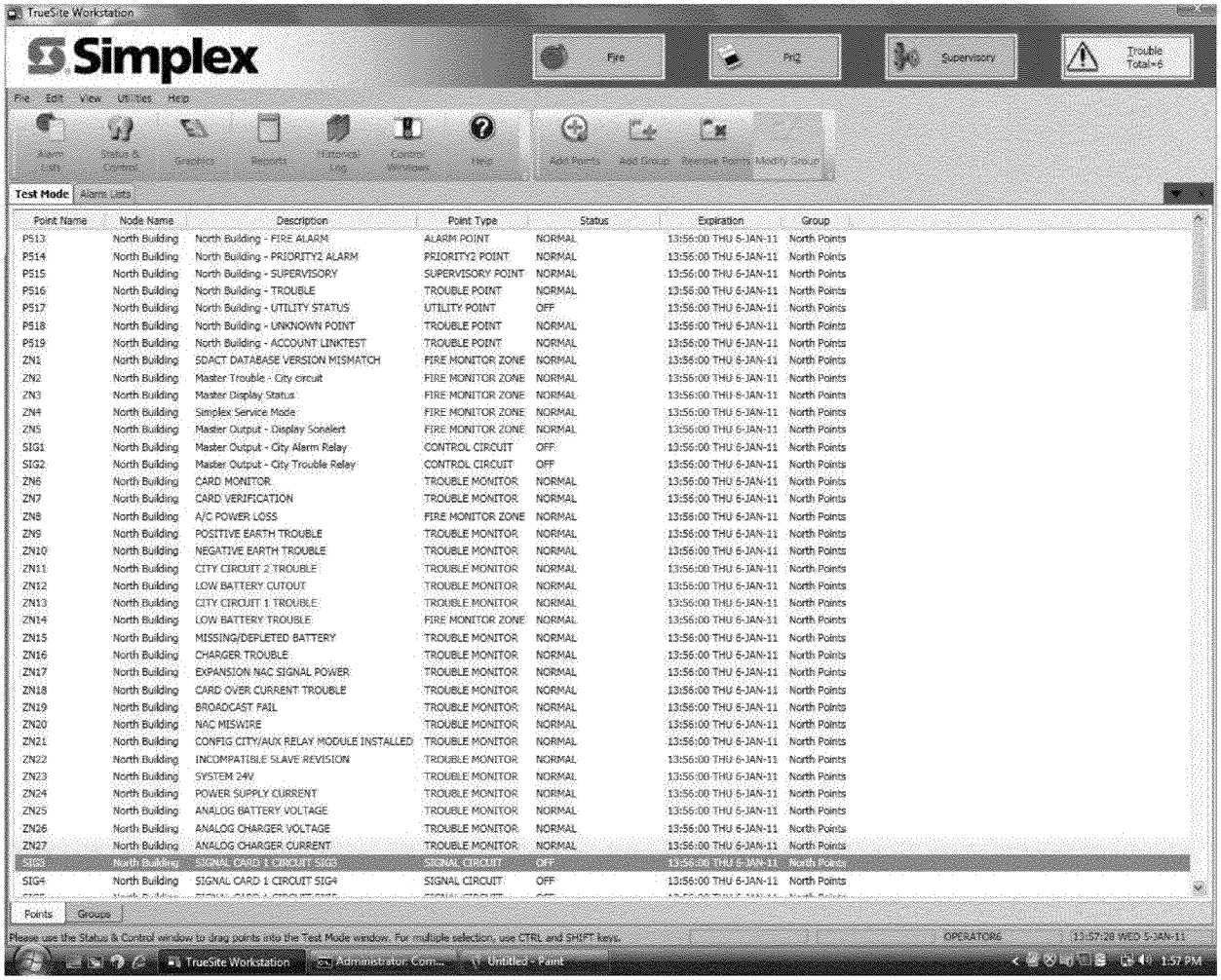
FIG. 4 is an exemplary screen shot showing a test mode tab with a points sub-tab selected.

From the Utilities pull-down menu (in the system menu bar of the operator interface screen, a "Test-Mode" button (FIG. 3) provides access to a Test-Mode tab (FIG. 4). In the Test-Mode tab, an operator stationed at a workstation node 1 or at one of its remote clients can place points into test-mode.

As previously noted, the purpose of the test-mode feature is to have one history log with all network test events in it to prove that a fire alarm is being tested as required. It will be appreciated that fire alarm testing is just one example, and that the test mode feature can be used for a wide variety of types of events (e.g., fire, trouble, supervisory, trouble, and the like.) Thus, the test-mode feature facilitates compliance with testing requirements and provides documentation to prove that testing was completed.

It should be noted that adding or removing a point from the test-mode does not change the state of the point at the panel. It will still be a live point at the owning panel. If a point is in test-mode when it goes into alarm, it will not show up in the workstation node banner or alarm list. The event will not print, graphics icons will not change and there will be no flashing or any indication requiring acknowledgement from the operator, unless the point is still in alarm when it is taken out of test-mode.

The Test-Mode tab gives access to two sub-tabs, Points and Groups (where a group represents a selected grouping of multiple points). In one embodiment, the Points sub-tab is selected by default when the Test Mode sub-tab is activated.

Test-Mode Sub-Tabs

Figure 5:
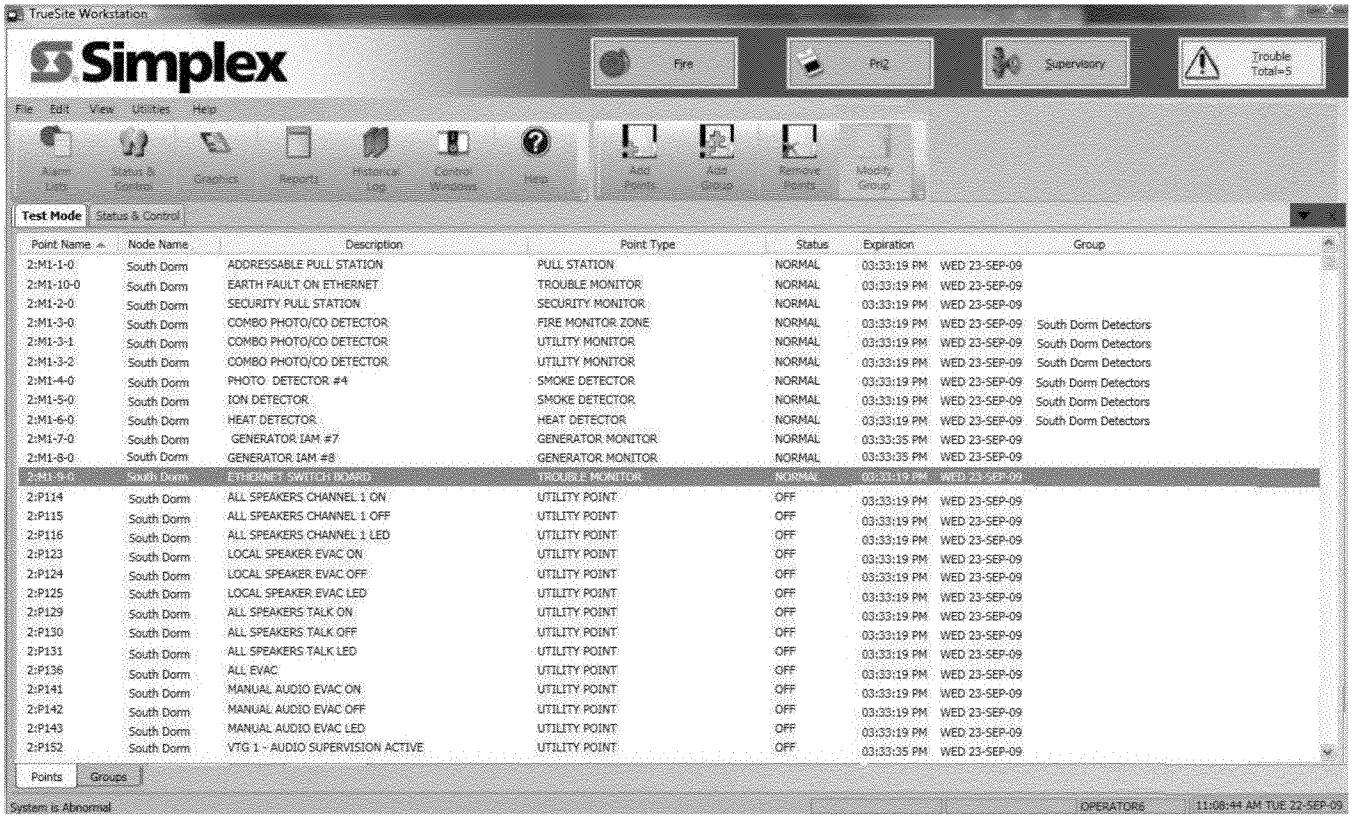
FIG. 5 is an exemplary screen shot showing a test-mode points tab.

Referring to FIG. 5 the Test-Mode Points sub-tab is shown. This view shows a grid/list all of the points which are currently in test-mode. The Test-Mode Points tab may contain a grid with the following columns: Point Name, Node Name, Description, Point Type, Status, Expiration (time/date stamp), and Group.

Figure 6:
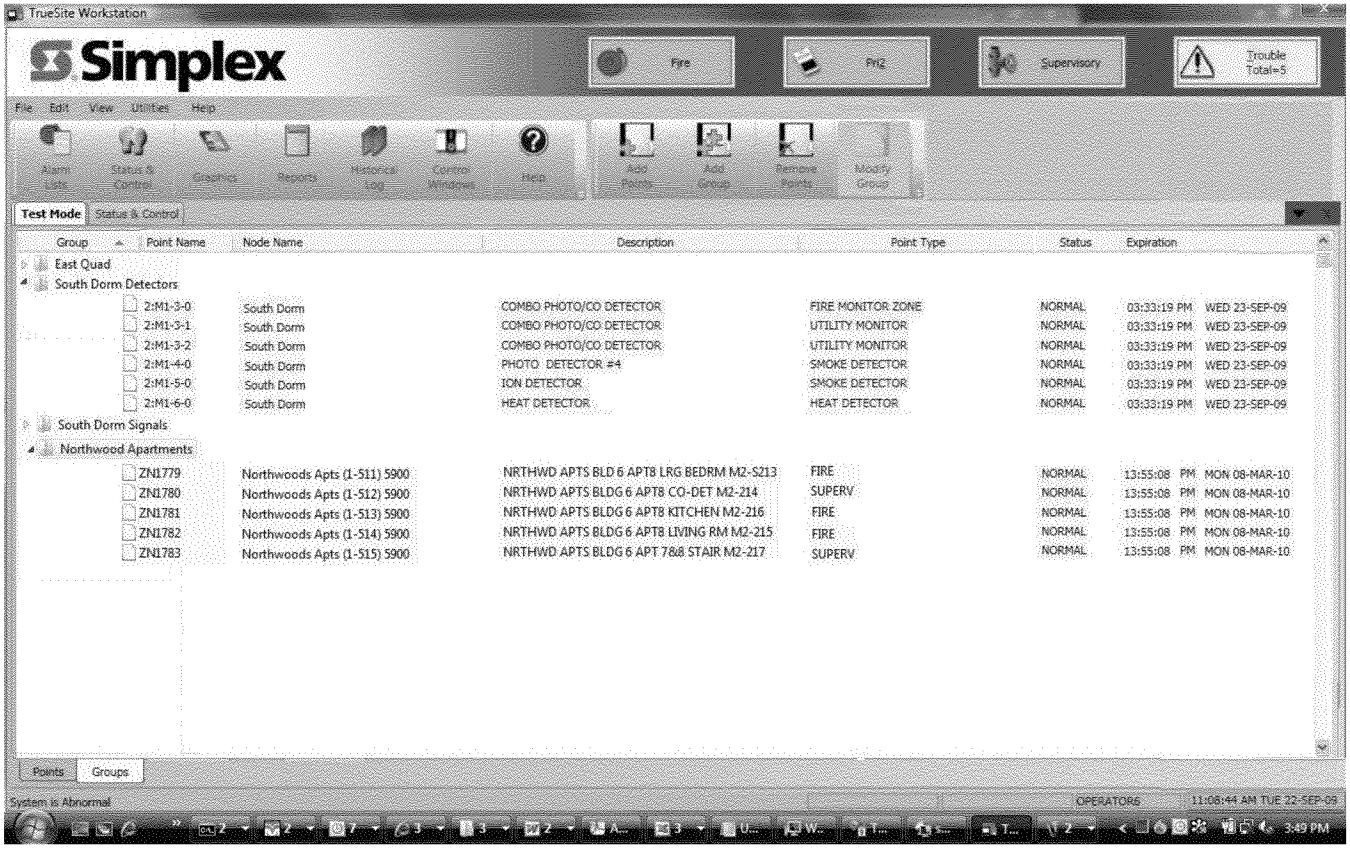
FIG. 6 is an exemplary screen shot showing a test-mode groups tab.

When on the Test-mode Groups sub-tab (see FIG. 6), the view will show a grid/list all of all active test-mode groups for a current job. The Test-Mode Groups tab may contain a grid with a plurality of columns, including "Group," "Point Name," "Node Name," "Description," "Point Type," "Status," and "Expiration (time/date stamp)."

In the illustrated example, the South Dorm Detectors group shows an example using external points from a Simplex Fire panel; the Northwood Apartments group shows an example using points from a DACR account. It will be appreciated that a point can only be in one test-mode group at a time.

Figure 7:
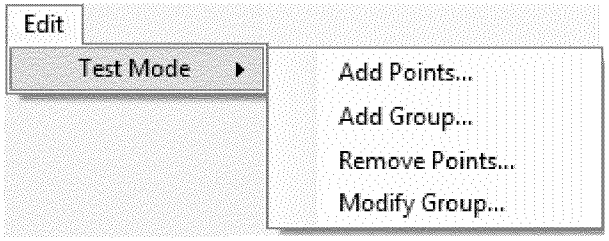
FIG. 7 is an exemplary screen shot showing a test-mode edit menu.
Figure 8:
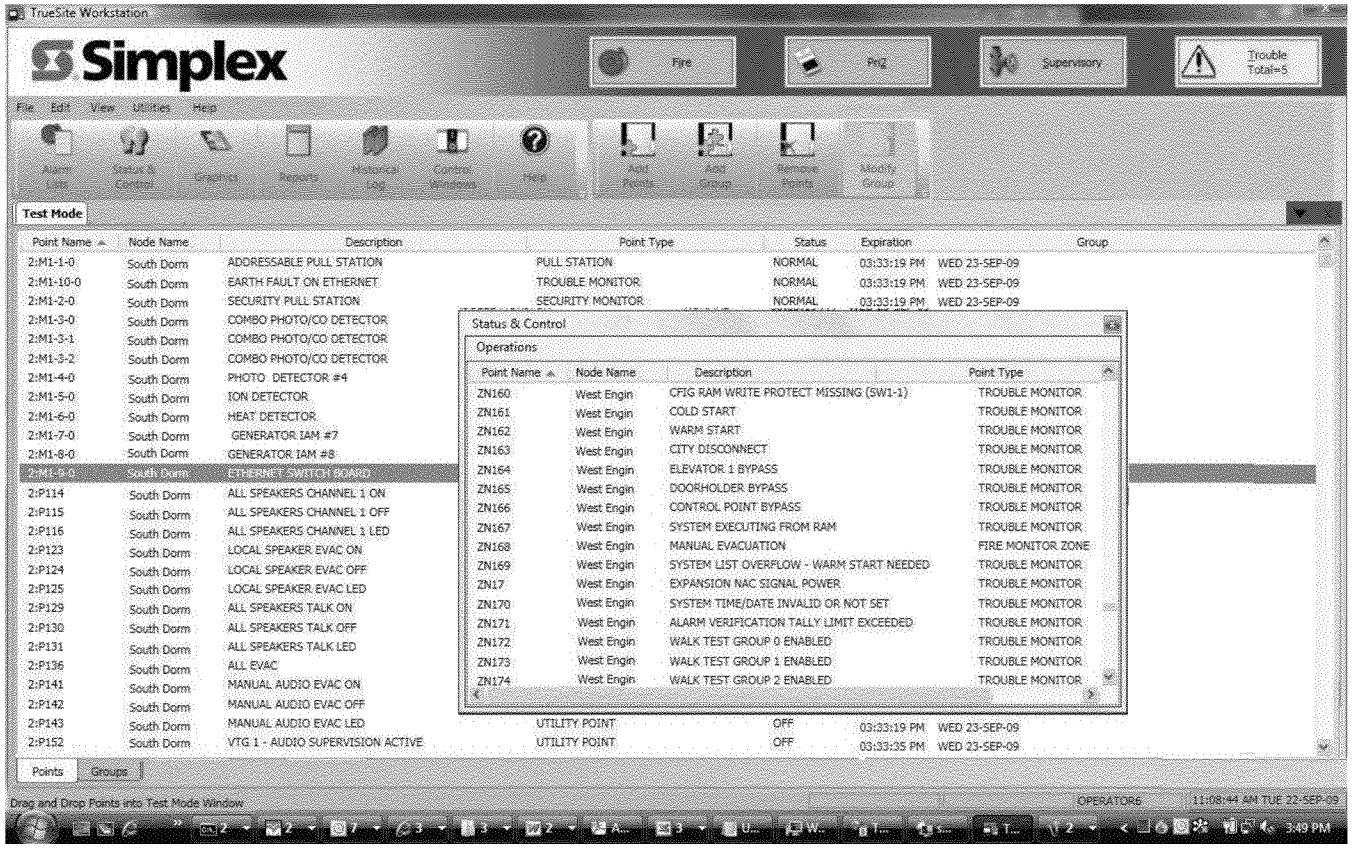
FIG. 8 is an exemplary screen shot showing a test-mode drag and drop window.

When the test-mode tab is active, the Edit menu/toolbar (see FIG. 7) will be usable. This menu allows the operator to add or remove points to/from test-mode. The Edit pull-down menu can contain an entry for test-mode with pull-right menus for adding points, adding groups, removing points, or modifying groups. Points can be selected individually, by category, by an entire DACR account; or by an entire network node such as a Simplex Grinnell 4120 node, which is network fire alarm system that provides built-in system redundancy and the capability to support up to 50,000 addressable points along the system. The ability to move points in/out of test-mode can be access-level protected. When the operator selects "Add Points . . . ," the Points Status & Control window (see FIG. 8) may appear as a floating window and the workstation node 1 will allow the operator to drag and drop points in/out of test-mode.

Figure 9:
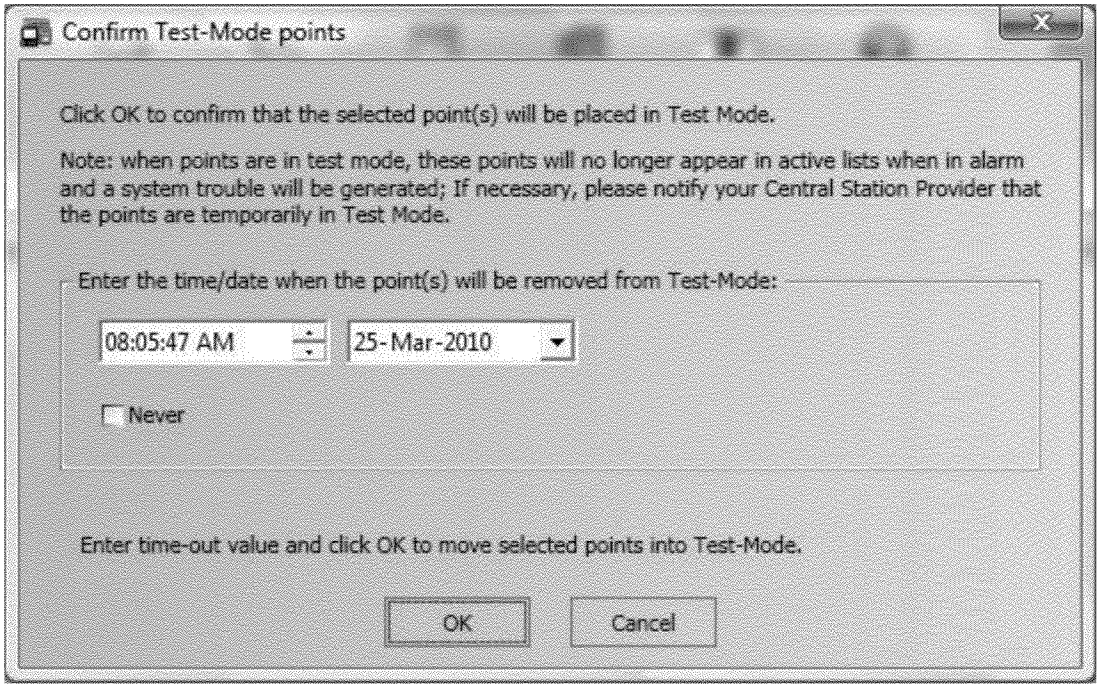
FIG. 9 is an exemplary screen shot showing a confirm test points dialog box.

The workstation node 1 can provide a confirmation prompt that enables the user to confirm that a point (or group of points) should be placed in test-mode. In some embodiments, the workstation node 1 can provide a confirmation prompt with precise details (which points, where located, timeout value, etc). FIG. 9 shows an exemplary confirmation prompt. The workstation node may allow test-mode points to expire (i.e., time-out) after a selectable period of time; or it may retain test-mode points in test-mode until explicitly removed by selecting a "Never" checkbox.

When points are manually taken out of test-mode, the workstation node 1 will prompt the operator before removing the points. For example, a prompt such as "Note: If any of the points are in a non-normal state or require reset, the points will be added to the workstation node active list window and may require acknowledgement." The workstation node 1 may allow the operator to cancel the removal of one or more points to keep these points in test-mode. During shutdown or restart of a workstation node, a warning may be provided to the operator if any points are still in test-mode.

When a point is in test-mode and it goes into a non-normal state, the point state change is reported on the owning panel, but the point will not appear in any workstation node banner or active list. For embodiments in which the point has a graphics color or shape link, the link will not change state (i.e., it will stay normal). The event will be recorded in a workstation historical log—with an indicator that depicts the point as in test-mode. However, no acknowledge of the event will occur at the workstation node 1. If a group or global acknowledge occurs at the workstation node, it will not affect any points in test-mode. In addition, no printing of the event will occur at the workstation node. When a point is in test-mode, and its primary state (e.g., normal, on, off) changes, a status column in the active test-mode grid will update to show the current status (e.g., fire alarm state).

History Log

Figure 10:
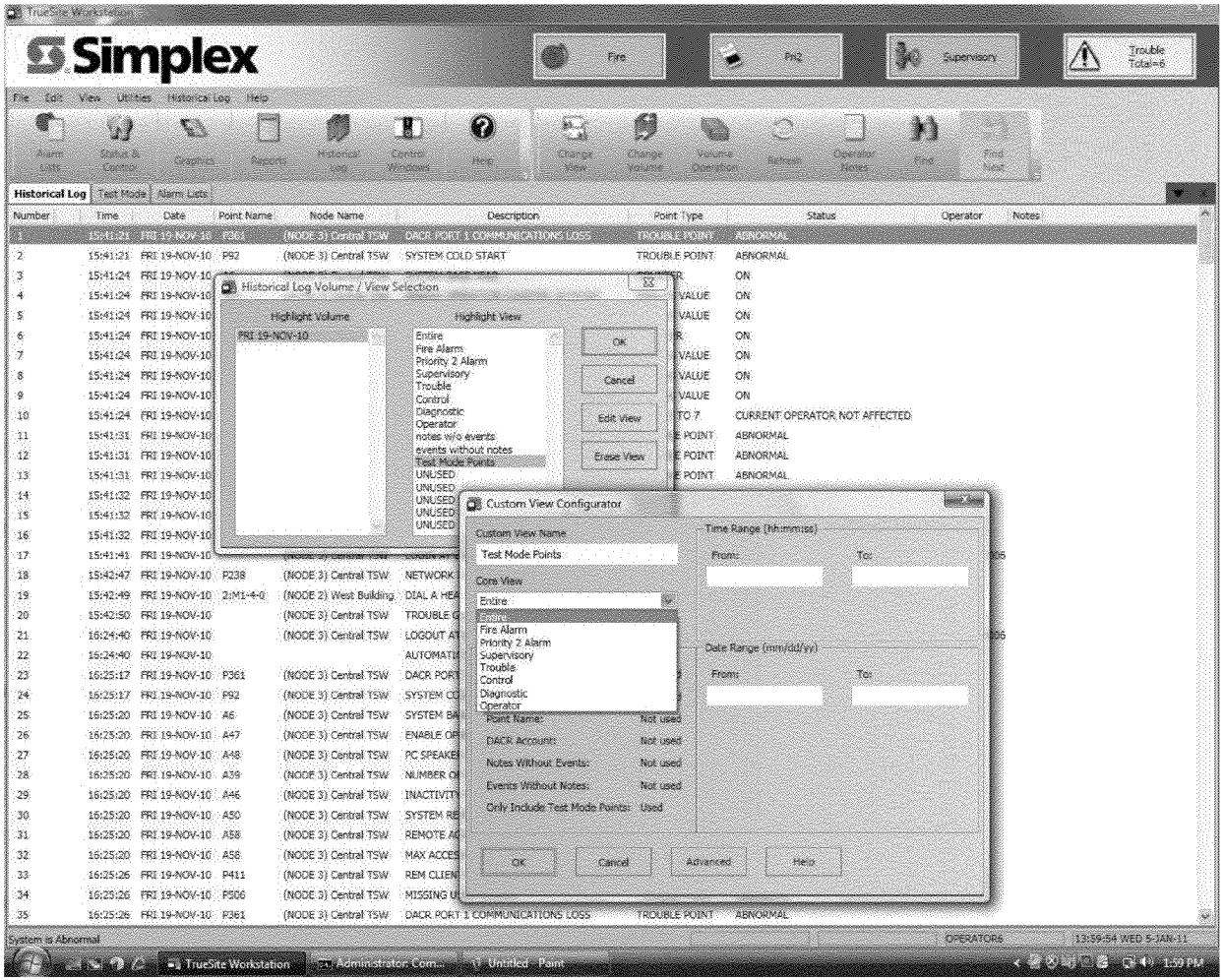
FIG. 10 is an exemplary screen shot showing a historical log test-mode view.
Figure 11A:
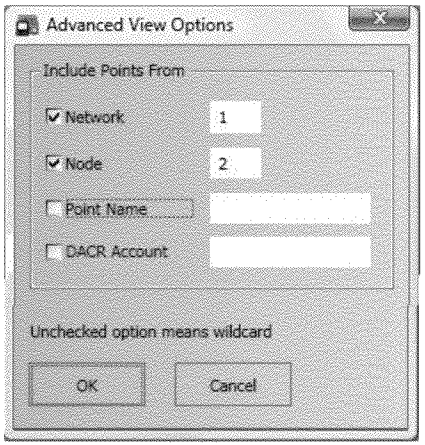
FIGS. 11A and 11B are exemplary screen shots showing exemplary historical log advanced view options.
Figure 11B:
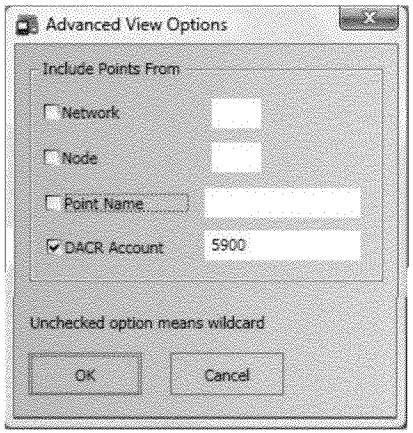

Events from points in test-mode will still be logged to a Historical Log, and will be identified as test-mode events. Referring to FIG. 10, The History Log Change-View dialog can be updated to allow the operator to filter the view to show only test-mode events. Further filtering can be done by time/date or 4120 node or DACR account, as shown in FIGS. 11A and 11B.

Figure 12:
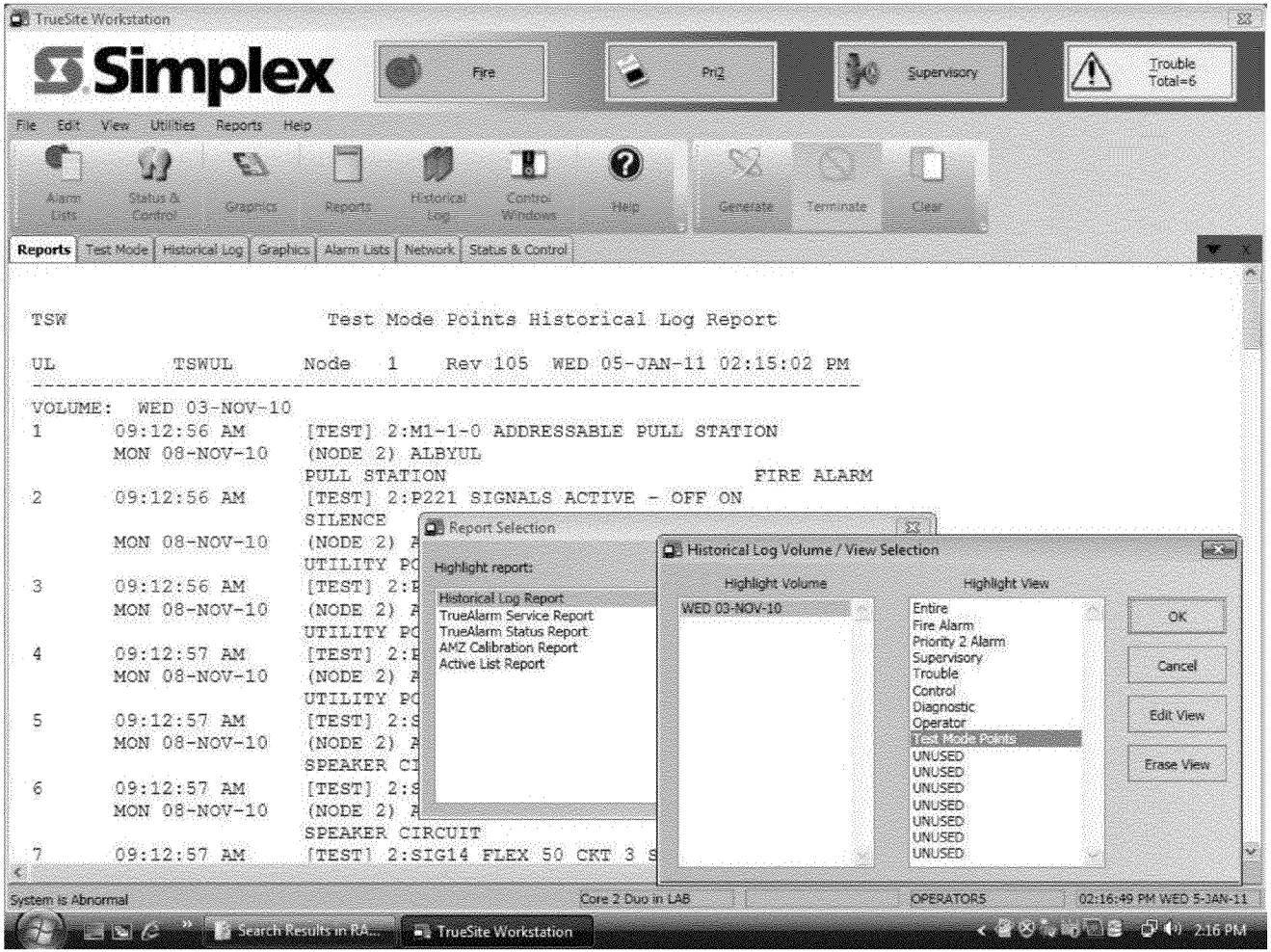
FIG. 12 is an exemplary screen shot showing a test-mode report.

Referring to FIG. 12, the Operator can generate/print a report of all test-mode events by using a custom view. Similar to the History Log, the operator can filter the results by time/date, 4120 node, or other desired category.

Points Status and Control Tab

Figure 13:
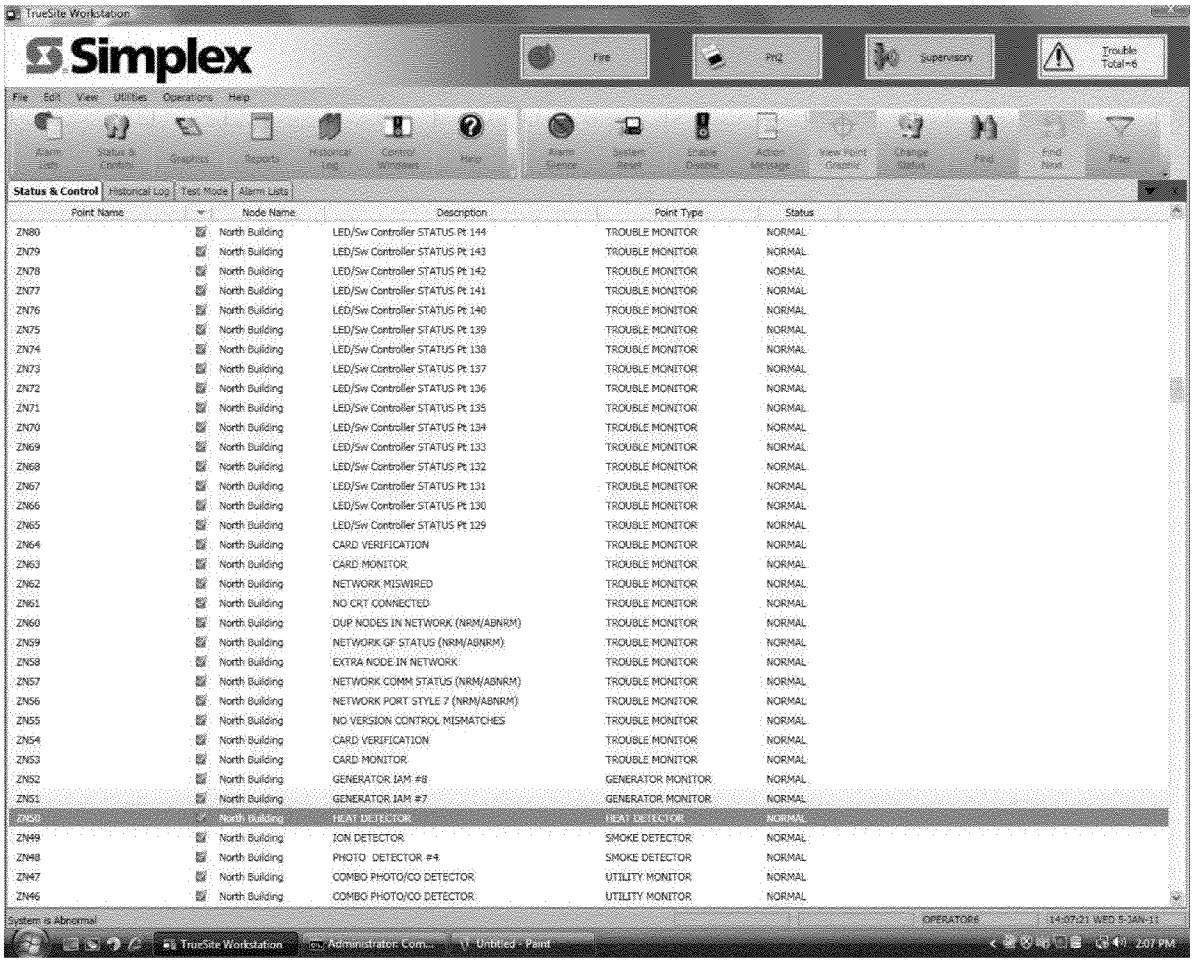
FIG. 13 is an exemplary screen shot showing a status and control tab test-mode indicator.

Referring to FIG. 13, a Points Status and Control tab grid can add a new column to show an indicator if a point is in test-mode. The operator can sort by column to show all test-mode points together.

Points Status and Control Dialog

Figure 14:
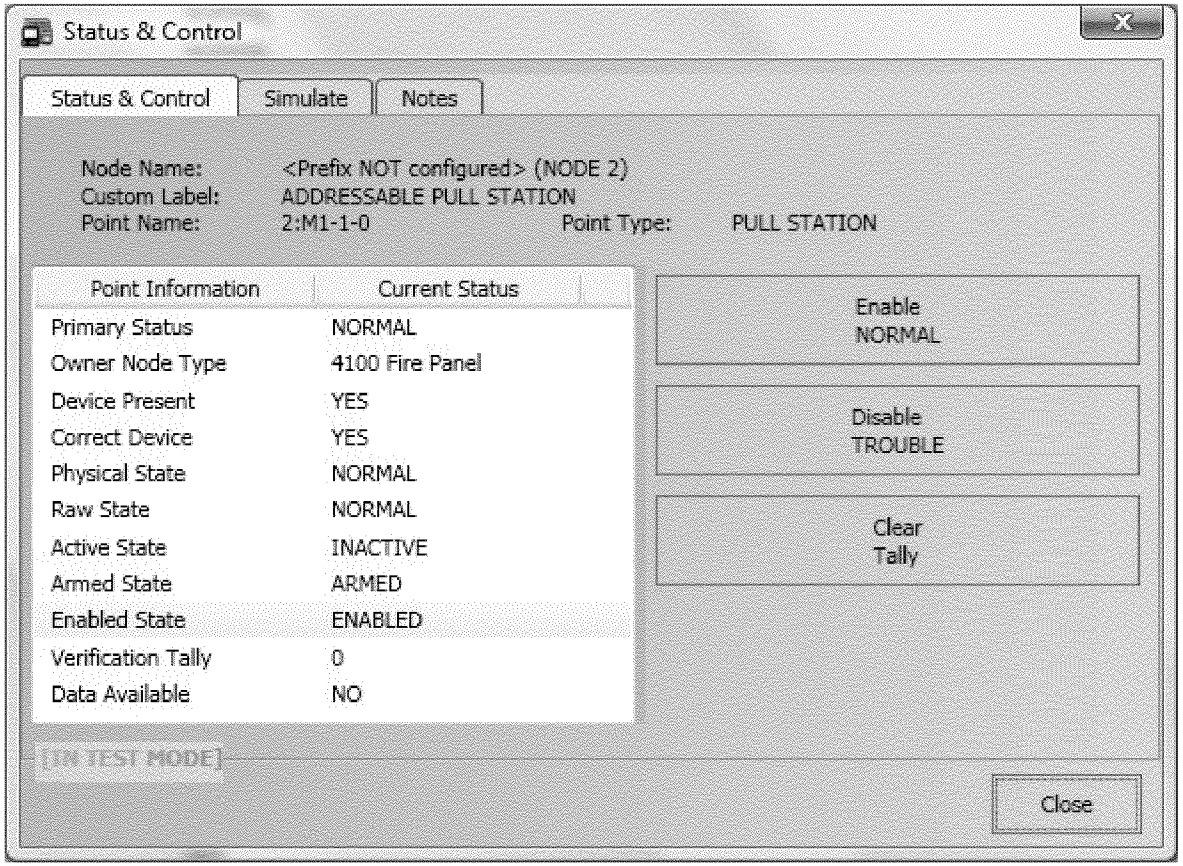
FIG. 14 is an exemplary screen shot showing a status and control dialog test-mode indicator.

If a point is selected for display in the Point Status & Control dialog (see FIG. 14), the workstation node 1 can display all of the current/active information for the point. In addition, the dialog will display a clear indicator that the point is in test-mode. It should be noted that if the operator selects a control operation (i.e., an operation that enables or disables a point), the operation can take effect, despite the fact the point is in test-mode. This is because the system remains "live" during test-mode operation.

Configuration

To support test-mode, the System Level and Access Level can be set to control the use of the test-mode tab. By default, there are no points in test-mode when the workstation node runtime starts. Upon a restart of the workstation node 1, points in test-mode can be maintained in test-mode unless expiration time has expired. When a job is built or rebuilt, all points can be taken out of test-mode.

Points can be added to test-mode even if the point is in Alarm or Walk-Test or other some other (non-normal) state. In addition, if a point is in Test-Mode and the owning node goes offline, the point shall stay in test-mode. (It will be appreciated that each device (point) is physically wired to a fire panel that "owns" the point. The points are then made public on the network and shared with the workstation node so that the workstation can display the point status.) Furthermore, upon shutdown or restart of the workstation node, if any point is still in test-mode, the workstation node will display a message to warn the user that some points are in test-mode: "Warning: some points are still in test mode. These points will stay in test-mode upon the next workstation startup unless the expiration period expires. Select CANCEL to abort the shutdown." This dialog may only be displayed at the workstation node, and not at remote clients.

The disclosed test-mode feature does not affect walk test operation of the fire panels (walk test operation is a procedure in which points are individually tested off line (i.e., off the network)). Thus, if a fire panel is in walk test, it is disconnected from the network during the walk-test.

Figure 15:
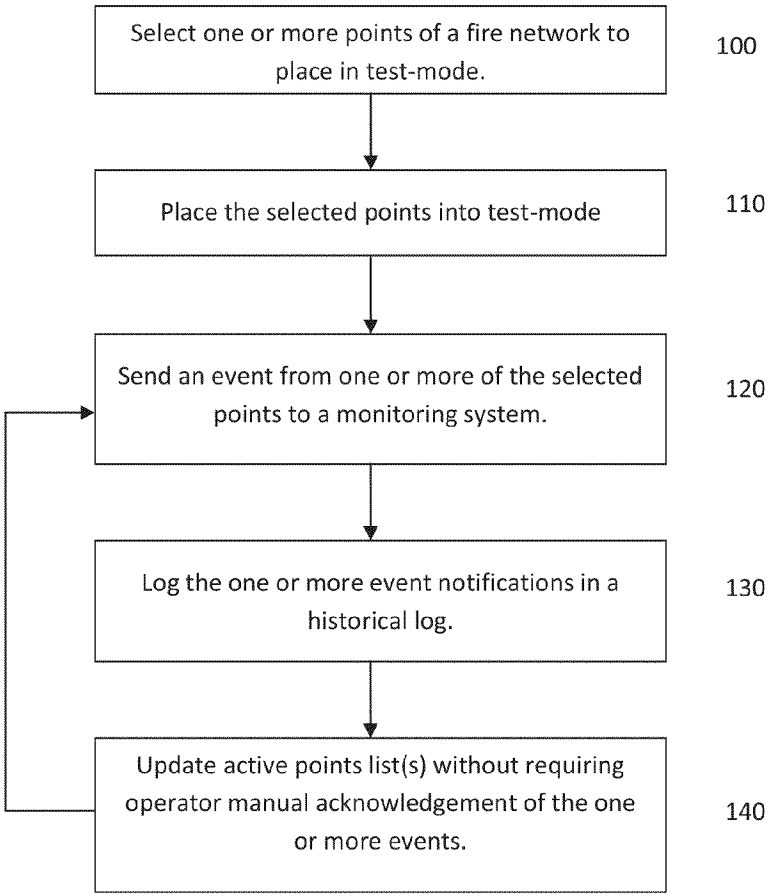
FIG. 15 is a flowchart illustrating an exemplary method in accordance with the disclosure.

Referring now to FIG. 15, an embodiment of the disclosed method will be described in greater detail. At step 100, the operator selects one or more points of a fire system to be placed into test-mode. At step 110, the selected points are placed into test-mode. At step 120 a selected point sends an event (i.e., state change) notification to the system. At step 130, the event is logged in a historical log. At step 140, one or more active points lists are updated to reflect the event, without requiring specific manual operator acknowledgement of the event.

In one non-limiting exemplary embodiment, the disclosed workstation 1 may be a Microsoft® Windows® XP-based or Vista-based computer platform.

The workstation software may be a PC-based application that provides headend annunciation, floor plan display, system control, and information management. It may be an integral part of an alarm system. In one embodiment it can be a node on a Simplex 4120 fire network used to annunciate and control the points contained within the 4120 fire network. The workstation software may house network cards and physical connections to all associated fire networks (such as 4120, 2120, and DACR). The workstation can monitor up to seven 4120 fire network loops. An additional feature on the workstation allows it to be accessed from a remote computer (referred to as a "remote client"). To do so, the workstation software can be installed on the remote client.

In one embodiment, the workstation software can be a Microsoft Windows®-based application that makes it easy for operators to respond to system events such as active alarms.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A system for monitoring and testing a fire or building system, comprising:

a workstation comprising a processor coupled to an operator interface, and a fire/building system comprising a plurality of system points, the workstation in communication with said building system for monitoring said system points;

the workstation configured to designate a plurality of system points for inclusion in a test-mode operation such that the plurality of system points are tested while the system points are live, to receive event notifications representative of a status of at least one of said plurality of system points, to log said event notifications in a log, and to update an active points list to reflect the event without requiring operator acknowledgement of the event.

2. The system of claim 1, said system point selected from the list consisting of a smoke alarm, a heat alarm and a motion detector.

3. The system of claim 1, said event comprising a state change notification.

4. The system of claim 3, said state change notification comprising an alarm notification.

5. The system of claim 1, the workstation further configured to remove the test-mode operation designation from one or more of the plurality of system points designated for inclusion in the test-mode operation after a selected amount of time has elapsed after the one or more of the plurality of system points were designated for inclusion in the test-mode operation.

6. The system of claim 1, the workstation further configured to, prior to shutting down or restarting, determine if one or more of the plurality of system points are designated for inclusion in the test-mode operation and generate a message indicating that one or more of the plurality of system points are designated for inclusion in the test-mode operation.

7. A method for testing a fire or building system, comprising:

designating a plurality of system points for inclusion in a test-mode operation such that the plurality of system points are tested while the system points are live;

during said test-mode operation, generating an event notification representative of a status of at least one of said plurality of system points;

logging said event notification in a log; and updating an active points list to reflect the event, without requiring operator acknowledgement of the event.

8. The method of claim 7, said system point selected from the list consisting of a smoke alarm, a heat alarm and a motion detector.

9. The method of claim 7, said event comprising a state change notification.

10. The method of claim 9, said state change notification comprising an alarm notification.

11. The method of claim 7, further comprising removing the test-mode operation designation from one or more of the plurality of system points designated for inclusion in the test-mode operation after a selected amount of time has elapsed after the one or more of the plurality of system points were designated for inclusion in the test-mode operation.

12. The method of claim 7, further comprising:

detecting a request for said workstation to shut down or restart;

determining if one or more of the plurality of system points are designated for inclusion in the test-mode operation; and generating a message indicating that one or more of the plurality of system points are designated for inclusion in the test-mode operation.

13. A system for monitoring and testing a fire or building system, comprising:

a workstation comprising a processor coupled to an operator interface, and a fire/building system comprising a plurality of system points, the workstation in communication with said building system for monitoring said system points;

the workstation configured to designate a plurality of system points for inclusion in a test-mode operation such that the plurality of system points are tested while the system points are live, to receive event notifications representative of a status of at least one of said plurality of system points, to log said event notifications in a log, and to update an active points list to reflect the event, wherein operator acknowledgement of the event is required if and only if the associated point is not in test mode.

14. The system of claim 13, said system point selected from the list consisting of a smoke alarm, a heat alarm detector.

15. The system of claim 13, said event comprising a state change notification.

16. The system of claim 15, said state change notification comprising an alarm notification.

17. A system for testing a fire or building system, comprising:

means for designating a plurality of system points for inclusion in a test-mode operation;

means for generating an event notification representative of a status of at least one of said plurality of system points during said test-mode operation such that the plurality of system points are tested while the system points are live;

means for logging said event notification in a log; and means for updating an active points list to reflect the event, without requiring operator acknowledgement of the event.

18. The system of claim 17, said system point selected from the list consisting of a smoke alarm, a heat alarm and a motion detector.

19. The system of claim 17, said event comprising a state change notification.

20. The system of claim 19, said state change notification comprising an alarm notification.

* * * * *